United States Patent [19]

Petrone

[11] Patent Number: 4,838,285

[45] Date of Patent: Jun. 13, 1989

[54] GOLF TEE CIGARETTE HOLDER

[76] Inventor: Louis Petrone, 5384 Greenridge Dr., Pittsburgh, Pa. 15236

[21] Appl. No.: 89,763

[22] Filed: Aug. 27, 1987

[51] Int. Cl.[4] ..... A24F 13/08; A24F 13/12

[52] U.S. Cl. ..... 131/259; 131/260; 273/32 B; 273/33

[58] Field of Search ..... 131/259; 273/33, 32 B

[56] References Cited

U.S. PATENT DOCUMENTS

D. 210,837 4/1968 Warner ..... 273/33
3,001,529 9/1961 Watson ..... 131/259
4,475,676 10/1984 Smith ..... 273/32 B

FOREIGN PATENT DOCUMENTS 0347374 8/1960 Switzerland ..... 131/259

*Primary Examiner*—V. Millin
*Attorney, Agent, or Firm*—William J. Ruano

[57] ABSTRACT

A golf tee having a substantially V shaped groove for receiving and holding cigarettes, cigars or the handle of a golf club to avoid infection by dangerous residue of herbicides, pesticides and fertilizers if they were laid on the turf, tees or greens. The tee is inserted in the ground in the normal way.

2 Claims, 1 Drawing Sheet

Fig.1
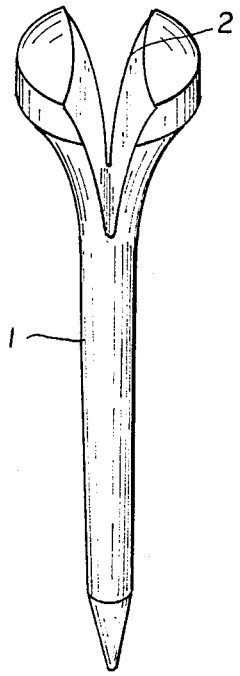
Fig.2
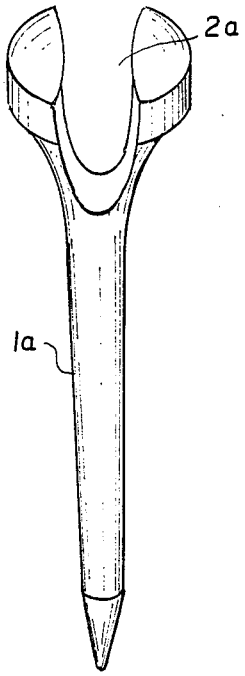
Fig.3
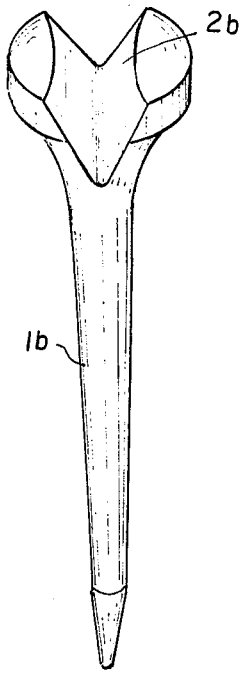
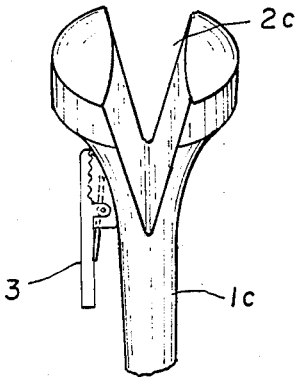
Fig.4
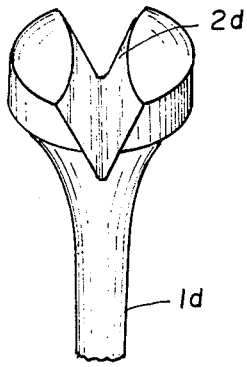
Fig.5
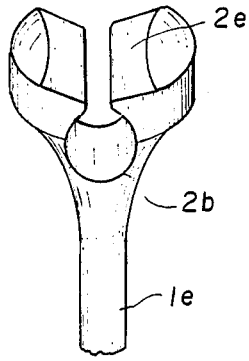
Fig.6
Fig.7
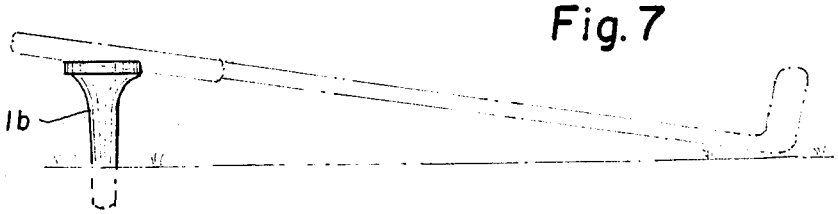

GOLF TEE CIGARETTE HOLDER

This invention relates to a cigarette holder simulating a golf tee and useful by inserting it into the ground.

BACKGROUND OF THE INVENTION

Smoking golfers will usually lay a lighted ciragette on the golf course while hitting a golf ball with a club. This involves not only danger in igniting the grass but subjecting the golfer to dangerous residue of herbicides, pesticides and fertilizers which are used on all parts of the golf course, particulaly tees and greens. Other conditions of uncleanliness may result from the ground being stampled on by large numbers of persons.

SUMMARY OF THE INVENTION

An object of the invention is to provide a novel cigarette holder of simple and inexpensive construction which is easily carried by the golfer much the same way as carrying golf tees, that is in his pocket.

A golf tee is provided with a V-shaped notch at the top which serves as a cigarette holder and which golf tee is easily pierced into the ground anywhere on the golf course.

BRIEF DESCRIPTION OF THE DRAWINGS

FIG. 1 is a perspective view showing a golf tee cigarette holder; and

FIGS. 2 to 6 inclusive show modifications thereof.

DETAILED DESCRIPTION OF THE PREFERRED EMBODIMENTS

FIG. 1 shows a golf tee 1 made of any material such as wood, plastic, aluminum, etc. A wedge shaped opening 2 is provided which is wide enough to hold a cigarette. The two outwardly flared top portions are flexible enough to firmly hold a cigarette pressed down therein. The lower portion is like the shank of a regular golf tee and is preferably made of substantially the same dimension as a golf tee.

FIG. 1*a* is a top view showing a wedge cut.

FIG. 2 shows a modification of the tee 1*a* to hold a cigar wherein the top opening 2*a* is more rounded and the top portions are further apart, the opening being substantially U-shaped. In some instances, by simply making a deeper wedge and a greater spacing between the top arms in FIG. 1, the tee may be made useful for both cigars and cigarettes.

FIG. 3 shows a tee 1*b* having a somewhat V-shaped top portion of greater depth than in FIG. 1 so as to enable support of a cigar in the upper portion and a cigarette in the lower portion.

FIG. 4 shows a golf tee cigarette holder 1*c* in combination with a spring clip 3 to enable it to be carried in the pocket of the golfer.

Other variations may also be made, for example, the construction may be such that the golf tee 1*d* is used both as a tee and as a cigarette holder, such as shown in FIG. 5. The top portion thereof is dished out into spherical form so as to support a golf ball when used as a tee and the somewhat V-shaped groove will serve as a holder for cigarettes when it is desired to use the golf tee as a cigarette holder.

FIG. 6 shows a tee 1*e* similar to FIG. 5 but having a circular cut out 2*b* for holding cigarettes or cigars. FIG. 7 shows the tee of FIG. 3 supporting a golf club.

Thus it will be seen that I have provided a novel golf tee type cigarette holder which can be pierced into the ground anywhere in the golf course and will safely hold a cigarette or cigar away from the ground, thereby eliminating dangers of contamination.

While I have illustrated and described several embodiments of my invention, it will be understood that these are by way of illustration only and that various changes and modifications may be contemplated in my invention and within the scope of the following claims:

I claim:

1. A golf tee having a top, golf ball supporting portion and having a stem portion of circular cross-section, said top portion being of substantially greater diameter than that of said stem portion, and a U-shaped opening extending from said top portion into said stem portion, together with a clip entending vertically underneath said top portion and alongside said stem portion.

2. A golf tee having a top, golf ball supporting portion and having a stem portion of circular cross-section, said top portion being of substantially greater diameter than that of said stem portion, and a circular opening extending from said top portion into said stem portion.

* * * * *